United States Patent [19]

Myers

[11] Patent Number: 4,784,382

[45] Date of Patent: Nov. 15, 1988

[54] CHILDREN'S USER-FRIENDLY PODIUM

[76] Inventor: Elizabeth A. Myers, 502 W. Royal Palm Rd., Phoenix, Ariz. 85021

[21] Appl. No.: 886,896

[22] Filed: Jul. 18, 1986

[51] Int. Cl.[4] ..... A63J 5/00

[52] U.S. Cl. ..... 272/25; 446/73; D6/434

[58] Field of Search ..... 312/140.3, 330 R, 250, 312/290; 434/403, 428, 432; D6/419, 329, 338, 358, 434, 435, 440, 397; 446/390, 320; 272/25

[56] References Cited

U.S. PATENT DOCUMENTS

| | | | |
|---|---|---|---|
| Re. 168,659 | 1/1953 | Silverman | D6/420 X |
| Re. 215,665 | 10/1969 | Gjede | D6/419 |
| Re. 288,099 | 2/1987 | Abitz | D6/419 |
| 1,142,651 | 6/1915 | Winiecki | 434/432 X |
| 1,652,774 | 12/1927 | Fraser et al. | 434/432 X |
| 2,238,267 | 4/1941 | Katz | 434/432 X |
| 2,623,329 | 12/1952 | Dileva | 446/320 |
| 3,346,989 | 10/1967 | Ryan et al. | 446/198 |
| 4,127,948 | 12/1978 | Goy Yu Chin et al. | 434/432 X |
| 4,576,424 | 3/1986 | Nelson | D6/419 X |
| 4,583,957 | 4/1986 | Levy | 446/390 |

FOREIGN PATENT DOCUMENTS

| | | | |
|---|---|---|---|
| 1048118 | 11/1966 | United Kingdom | 35/60 |

*Primary Examiner*—Robert A. Hafer
*Assistant Examiner*—Kevin G. Rooney
*Attorney, Agent, or Firm*—Charles P. Padgett, Jr.

[57] ABSTRACT

A height-adjustable, user-friendly, child's podium for use by children from pre-school years through elementary school to the sixth grade which assists a child in learning to speak before groups without fear, tension and apprehension. The child's podium of the present invention includes at least one set of user-friendly facial features operatively disposed on the front or back of the podium for relaxing at least one of the speaker and the audience, respectively. Preferably, a set of tension-eliminating facial features is provided on both the front and rear of the podium. The podium is made from box-like nestable structures wherein the depth to which adjacent boxes can be nested within one another is manually adjustable to selectively adjust the height of the podium for different heights of children within a given class or grade or from grade to grade as the children grow. Furthermore, the children's podium may include robot-like arms which even further relax both the audience and the speaker, and which can be positioned in a fully retracted position within the interior of the podium or to a fully extended position for disposing a pair of flat platforms in a substantially horizontal position for holding show and tell objects, materials or the like. Lastly, the podium may include a base having caster wheels or the like for ease of rolling the podium from one position to another, and a locking device associated with the wheels for preventing movement once the podium is positioned at a desired location.

30 Claims, 1 Drawing Sheet

CHILDREN'S USER-FRIENDLY PODIUM

BACKGROUND OF THE INVENTION

1. Field of the Invention

This invention relates generally to a user-friendly children's podium for rendering speaking in front of a class, group, or audience and/or for the children's introduction to "public speaking" easier and less frightening to the child; and more specifically to a children's podium which provides a height-adjustable structure which is in the form of a friendly happy character or caricature and which includes a surface for supporting lecture notes and for providing an arm support for a standing child while he or she is addressing or speaking to an audience such as his or her class.

2. Description of the Prior Art

Most of today's schools do not actually concentrate on preparing a child for public speaking. Few, if any offer any, type of programs or training for kindergarten through sixth grade, for example. Even when such training is offered, the student is usually required to stand alone at his desk or in front of the room without the benefit of a podium behind which he or she can at least partially "hide" and feel less "exposed". It is quite frightening for young children (or even adults) to have to stand in front of the entire class or audience and talk or speak in any type of formal manner.

Some educators have recognized that early traumatic experiences relating to speaking in front of a class can effect the child throughout his or her career and render public speaking difficult, if not impossible, in the future. Some have begun using podiums and actually teaching public speaking in the higher grades. Where such podiums are introduced in the lower grades, such as in preschool facilities and in the elementary grades of kindergarten through sixth grade, the schools commonly use adult type podiums which are very frightening and authoritative, not only to the person giving the speech or talk, but also to the class or audience in general. A tense or apprehensive audience always makes speaking more difficult, frightening, and perhaps traumatic.

The child's user-friendly podium of the present invention overcomes substantially all of the objections to and the problems of the prior art, and provides an educational tool, training aid, or apparatus for enabling children, both the speaker and the audience, to feel less afraid, tense and apprehensive, and eventually even to welcome and/or look forward with eager anticipation to the experience of speaking before a group, class or audience.

BRIEF SUMMARY OF THE INVENTION

It is an object of the present invention to provide a children's podium which is especially adapted for the training of children in the early grades, such as in preschool and in kindergarten through sixth grade, for speaking before a group, class or audience in a "public speaking" situation.

It is another object of the present invention to provide a children's podium having features which tend to mitigate against apprehension, fear and timidity in the speaker.

It is a further object of this invention to provide a user-friendly child's podium which is especially adapted for the training of young children in public speaking and which is height-adjustable so as to be suitable for use by the child throughout the formative years of the growth of the child as he or she progresses from preschool to kindergarten through sixth grade, so that he or she continues to have a "friend" with him whenever public speaking is required.

It is yet another object of the present invention to provide a child's podium which is both height-adjustable and which includes features such as a happy smiling face and/or a robot-like appearance for placing children at ease and in a happy or at least less apprehensive mood.

It is still another object of the present invention to provide a children's podium for teaching public speaking to children in the lower grades, and wherein the podium has features which tend to influence the attitude of the audience, especially an audience of children, such that the speaker encounters a relaxed, friendly, receptive audience thereby further aiding the child in overcoming his or her own apprehension, fear and timidity; and actually, perhaps over time, making the public speaking experience a pleasant or at least non-troublesome event.

It is still a further object of the present invention to provide a podium which is especially adapted to the training of children in public speaking by providing comical or happy friendly faces on one or on opposite surfaces and robot-like features such as arms which tend to amuse, entertain and relax the children.

It is yet a further object of this invention to provide a podium having a surface for holding books, notes and materials, as well as possibly the child's elbows and/or forearms during speaking.

It is yet another object of the present invention to provide a podium which can be collapsed to a minimum height for storage purposes and raised to any desired given height to meet the needs of a particular student using the podium for speaking.

It is still a further object of the present invention to provide a podium with arm members which may be extended to provide further surfaces for storing, collecting or passing out papers, notes, homework assignments and the like, as well as for holding objects during "show and tell" or exhibits referred to in the speech or even for mounting visual aides, holding slides, etc.

The present invention shows or discloses a podium for teaching or aiding children, particularly pre-school and grade school children, in learning to speak without fear before a class, group, or audience, and to prepare the child for future public speaking. The podium includes removable or telescopically collapsible sections which enable height adjustments appropriate for various sized children from pre-school to kindergarten through the sixth grade; and it has both functional and ornamental features intended to cause the entire podium to resemble a happy human being, a cartoon character, or a friendly creature with whom the child can freely associate. The overall appearance of the podium,, which may also include robot-like features, has a subconscious, if not a directly conscious, effect on the audience as well as the child speaking, since it relaxes the audience, provides a more friendly atmosphere for the entire public speaking event, and generally promotes a friendly response to the speaker on the part of the audience which makes the entire speaking experience a positive one for the child utilizing the podium to give his or her speech.

The podium of the present invention may include a plurality of nested boxes which can be telescopically received or extended into and out of one another to provide height-adjustment capability for the many various sized children using the podium so that the podium can "grow" with the child from pre-school to kindergarten through sixth grade, and become a "friend" and "help mate" when public speaking is required. Furthermore, the arms may contain or include robot-like hands or disk-like platforms which are normally retracted into or flush against the sides of the podium, but which may be raised or extended to a substantially horizontal position for holding additional show and tell materials, for collecting and passing out homework assignments, and the like.

Furthermore, the upper surface of the podium may be tilted or slanted toward the speaker for holding notes, books or paper required by the child giving the speech and the top will normally include a raised lip, ledge or stop member to prevents objects on the top surface from sliding or falling off of the rearwardly and downwardly slanted top surface. Of course many children will utilize the surface for resting their elbows while they hide behind the podium, at least in the early developmental stages of public speaking. Lastly, the upper surface may be raised, lifted, or opened for access to a storage compartment in the top section and additional storage compartments can be provided, as by drawers or the like as the podium is opened or raised to higher levels.

These and other advantages and objects of the present invention will become more fully understood by reading the detailed description of the preferred embodiment, the claims, and the drawings, which are briefly described hereinbelow.

DETAILED DESCRIPTION OF THE PREFERRED EMBODIMENT

In order to introduce children and particularly young children such as those attending pre-school or grammar school such as in grades kindergarten through sixth grade, it is extremely important that the child does not become frightened, afraid or anxious regarding public speaking since it may effect his or her abilities in that area for many years to come or even indefinitely. The present invention provides a podium apparatus which is "user-friendly" to children, and which is adapted to be height-adjustable to enable the podium to grow with the child from grade to grade so as to become his partner, friend, confidant, or help-mate in the art of public speaking. The decor and design of the podium with its robot-like arms features and its happy smiling face are designed to relax not only the speaker himself or herself, but also to relax the audience in general so as to provide a more receptive audience for the speaker.

The entire design of the podium of the present invention is aimed at reducing or alleviating the child's fears, apprehensions, frustrations, and timidity and to emphasize the positive aspects or standing before a class and speaking so that as he or she becomes more and more able to stand behind this podium, he or she will gradually lose all fear of public speaking and actually look forward to taking part in public speaking exercises or opportunities.

Figure 1:
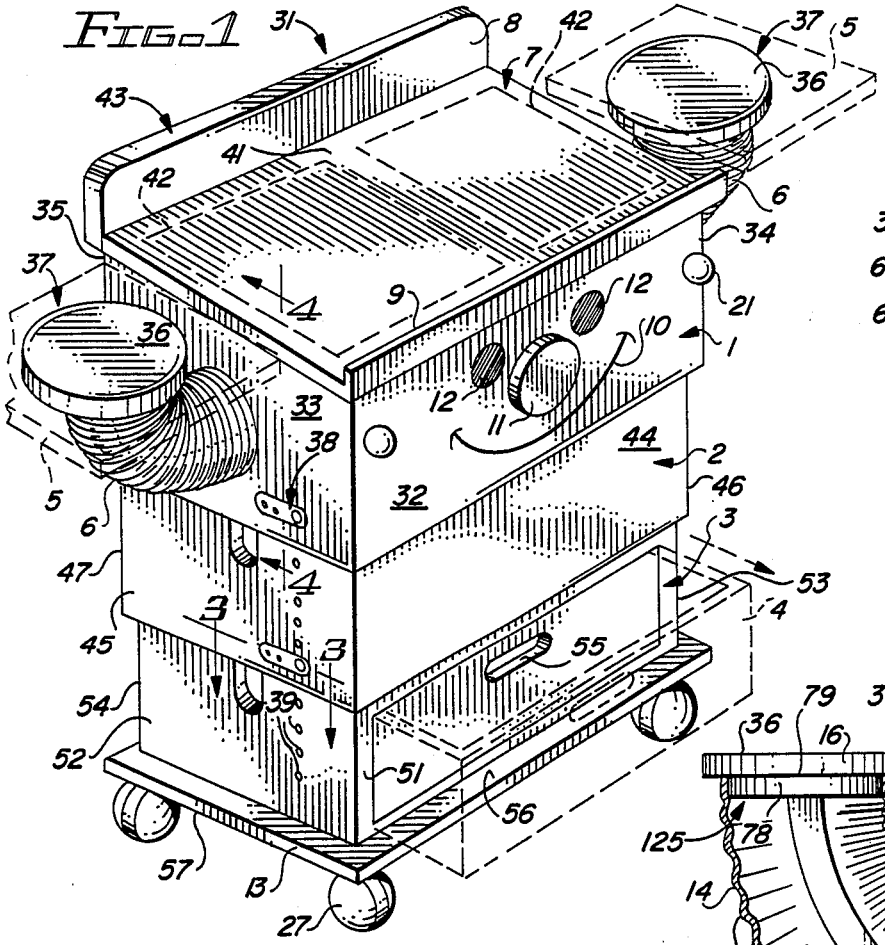
FIG. 1 is a perspective view of the children's user-friendly podium of the present invention.

FIG. 1 shows a perspective view of the height-adjustable, user-friendly children's podium 31 of the present invention. The podium 31 is shown as including a first base unit 1 which is substantially a hollow, generally rectangular, box-like construction. The base unit 1 includes a generally planar front surface 32, a left side surface 33, a corresponding right side surface 34, and a rear surface 35. The front surface 32 of the base unit 1 is shown as including a unique set of facial feature-forming indicia such as the happy smiling face comprising a wide smiling mouth 10, an oversize cartoon-like nose 11, and round colored eyes 12 of FIG. 1. The nose 11 and eyes 12 may be rotatable knobs or push-buttons which may be adapted to control functions such as lights or sound, as known in the art. The smiling mouth 10 may be a decal, transfer, or it may simply be painted on the surface 32. Furthermore, a pair of rosy cheeks or ears are represented by a pair of knobs 21 which are disposed on opposite sides of the face adjacent the far sides of surface 32. In the position of FIG. 1, the height is theoretically adjusted to its maximum which may, for example, be the maximum height for a tall child in sixth grade.

The podium 31 of FIG. 1 also shows a pair of extendible and retractable robot-like arms 6 which can be adapted to hold homework assignments, show and tell exhibits, or the like, as indicated by reference number 5, on the flat upper planar surface 36 of the disk-like hands 37 terminating the distal ends of the arms 6. A height adjustment device, represented generally by the reference numeral 38, is also positioned, located or operably disposed on the side 33 of the first base unit 1. A similar unit, of course, will normally be disposed on the opposite side of each corresponding unit for height adjustment purposes. A plurality of vertically-aligned apertures 39 may be used in conjunction with the height-positioning device 38 for adjusting the height, as hereinafter described.

The top of the box-like construction of the base unit 1 is formed by a platform 7 which is hingedly connected to the rear side 35 of the unit 1 so that the platform or lid 7 can be lifted, raised, or rotated about the hinges, not shown, but known in the art, to permit access to the hollow space within the interior of the box-like construction of the base unit 1, as desired. The platform 7 also includes a generally planar rectangular work surface portion 41 which is slanted or titled downward or tapered toward the user of the podium or toward the surface 32 of the base unit 1. The surface 41 may be used to pass out or collect homework assignments or the like, as indicated by the phantom lines 42, or may be use to position various books, notes or materials required for the user's speech, as desired. Similarly, the user can lean on the surface 41 or even rest his elbows thereon, at least in the early learning stages. The rear edge of the tilted surface 41 of the platform 7 terminates in a distal lip, ledge or stop member 9 which is generally perpendicular to and extends upwardly from the plane of the surface 41 so as to prevent any papers 42 or other objects disposed on the slanted surface 41 from sliding or falling off of the platform 7. At the opposite end or rear of the platform 7, an upwardly extending rear portion 43 extends generally vertically upward from the rear 35 of the platform 7 to at least partially hide the materials placed on the surface 41 from being seen or viewed by the audience while providing additional frontage behind which the partially hidden speaker feels less exposed.

The podium 31 also includes a second base unit 2 which has a front surface 44, a left side surface 45, an opposite side surface 46 and a rear surface 47. The side surfaces 45 and 46 again include a height-positioning device 38 and a plurality of height adjustment apertures 39, as previously described with respect to side 33 of the first base unit 1. Lastly, a third or bottom base unit 3 is provided with and includes a front surface 51, which may include a drawer 4 which can be pulled out for access to a hollow storage location by the handle 55. Similarly, the sides 52 and 53 include adjustment apertures 39, as previously described. The bottom or base of the lower base unit 3 is operatively disposed on a generally horizontal surface or planar 56 of a base platform 13. The lower surface 57 of the platform 13 is provided with a plurality of rollers or caster wheels 27 for enabling the podium 31 to be easily moved from spot to spot, as desired. Means may of course, be provided, as known in the art, for locking the castor wheels 27 in place once the podium 31 is positioned at a desired location, such as in front of a classroom or the like.

Figure 2:
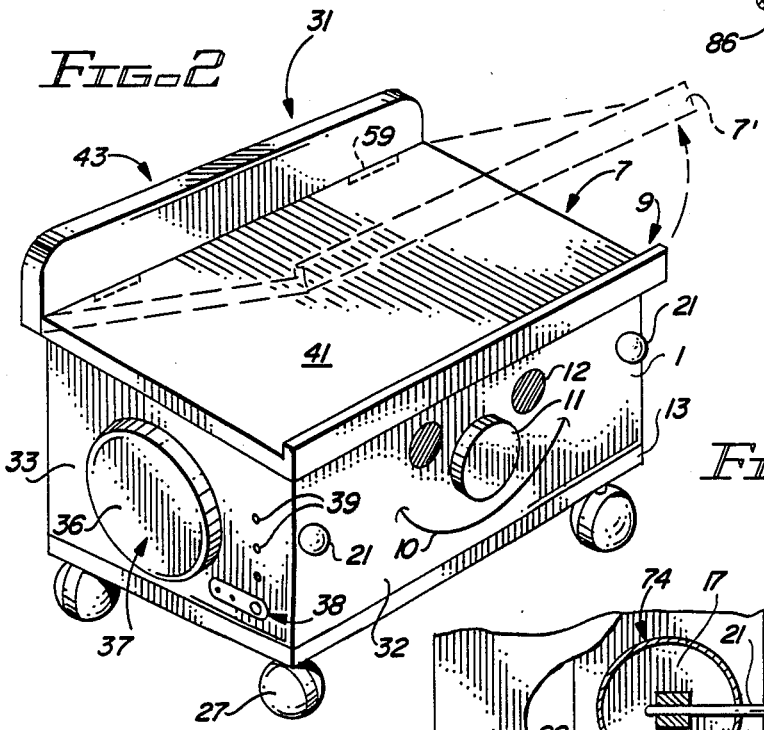
FIG. 2 is a similar perspective view of the podium of FIG. 1 in its collapsed or storage position.

FIG. 2 shows the podium 31 of FIG. 1 in the collapsed or fully-nested storage position. In FIG. 2, the platform 7 is shown in phantom lines as being opened or rotated upwardly about the hinges 59 for exposing the hollow interior, not shown, of the box-like structure of the base unit 1 for storing materials therein or the like. Furthermore, the arms 6 are shown as being fully retracted into the hollow interior of the base unit 1 with only the outer cylindrical disks 37 of the disk face 36 being disposed flush against the side 33 of the first base unit 1.

Figure 3:
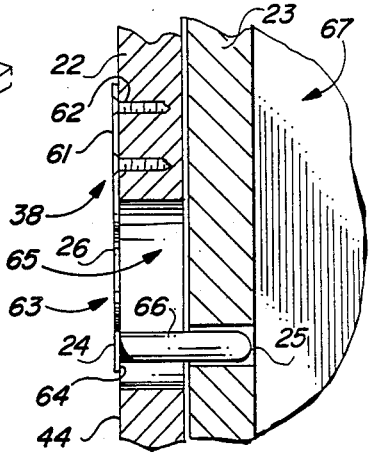
FIG. 3 is a partial sectional side view of the height adjustment mechanism of FIG. 1 taken along view lines 3—3 thereof.

FIG. 3 shows a partial sectional side view taken along view lines 3—3 of FIG. 1 to illustrate the height adjustment means in the connected or locked position for securing the second base unit 2 with respect to the first base unit 1 or the third base unit 3 with respect to the second base unit 2. FIG. 3 shows a side panel 22 as having an outer surface 45 thereon. The height adjustment device 38 is shown as including a tail or base portion 61 which is securely fastened or anchored to the panel 22 as by wood screws 62 or similar conventional fastening means, as known in the art. The opposite end portion of the height adjustment device 38 is designated generally by reference numeral 63 and it includes an intermediate aperture or finger hole 26, and a distal end portion 24 having an elongated, generally cylindrical, pin member 66 fixedly secured to the surface 64 thereof. The axis of the longitudinal pin member 66 is generally perpendicular to the plane of the member 61, 63 and is adapted for entering a substantially hollow channel portion, aperture or recess 65 in the wall 22 and then entering an aligned cylindrical channel or recess 25 formed in the corresponding side panel 23 of the next lower box or base unit 3, as designated by the nested wall or side portion 23. The hollow interior of the bottom box-like structure of base unit 3 is then identified by reference numeral 67. The intermediate portion between base 61 and pin end 24 has a spring-like resiliency which normally urges the pin 66 inwardly toward aligned channels 65 and 25.

Figure 5:
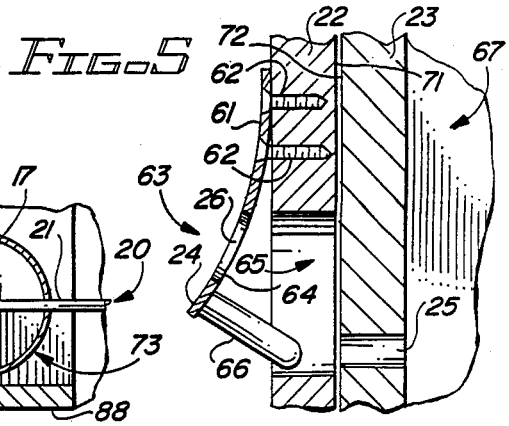
FIG. 5 is a partial sectional side view of the height adjustment mechanism of FIG. 3 with the locking element removed for height adjustment purposes.

As shown in FIG. 5, a person's finger or a hand tool can be placed within the access aperture 26 and used to overcome the spring bias of the members 61, 63 to pull the elongated pin portion 66 from the recess 25 to enable relative vertical movement up and down between the inner surfaces 71 and 72 of the corresponding sides 22 and 23, of units 2 and 3, respectively, for height adjustment purposes.

Figure 4:
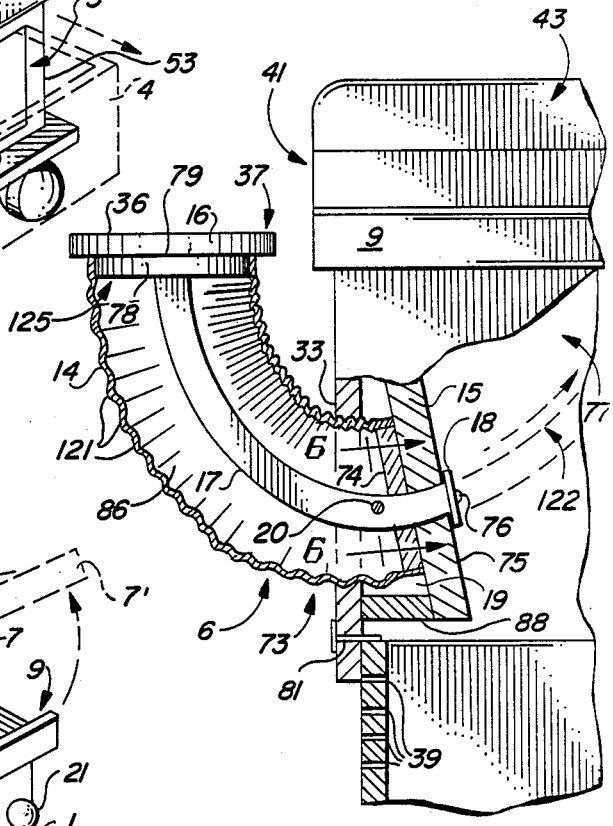
FIG. 4 is a partial sectional side view through an arm portion of FIG. 1 taken along view lines 4—4 thereof.

FIG. 4 shows a cross-section of the arm assembly 6 of FIG. 1. In FIG. 4, the arm assembly 6 is shown as having a flexible outer covering 73 and a hollow interior 86. Disposed within the hollow interior is a curved or arcuate member 17 having one end operatively coupled to or terminating and assembly 125 having in a generally cylindrical disk-like member 16 whose upper surface 78 supports the lower surface 78 of the outer disk, or hand member 37 whose upper horizontal surface 36 can be used to support objects for show and tell, exhibits, or to pass out or collect homework assignments and the like. The arcuate member 17 has its opposite end passing through a member 15 and terminating in a washer 18 and fastener element 76. The outer surface 75 of the member 15 faces into a hollow interior portion 77 into which the arcuate member 17 is slidably received when the disk-like portion 37 is depressed inwardly to fold up the accordion-like pleats 121 of the cylindrical sleeve 73 of the arm 6 so that the the smaller radius disk 125 is received into an aperture in the wall 133 and the hand disk 37 is disposed on or flush against the outer surface 33, as shown in FIG. 2. Member 88 connects the member 133 with the member 15, and a removable pin fastener or stop pin member 20 passes through the arcuate arm member 17.

Figure 6:
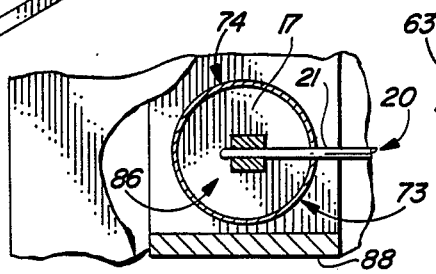
FIG. 6 is a partial sectional view of the arm-connecting portion of FIG. 4 taken along view lines 6—6 thereof.

When arcuate member 17 is pressed into the hollow interior 77 of unit 1, it follows the path generally indicated by reference number 122. The pleats 121 form a flexible shell 14 or outer covering for the arm 6. Pin 81 and apertures 39 are illustrated as a substitute for the height adjusters 38. FIG. 6 shows the hollow interior 86 of the sleeve member 73 of arm 6, and shows the elongated portion 21 of pin member 20 passing through an aperture 120 in the arm 17 so that when the pin 21 is removed, pressure can be applied to the surface 36 of the disk 37 to collapse the accordion-like pleats 121 of the sleeve 73 thereby pushing the arcuate arm member 17 into the hollow portion 77 until the rear surface 78 of the disk portion 37 is flush against the outside surface 133 of the left side of the base unit 1, as previously described with respect to FIG. 2.

In operation, the height of the podium 31 of the present invention can be adjusted by inserting a manual digit or tool into the aperture 26 of the spring-biased member 61, 63 so as to remove and insert the pin 66, selectively into and out of the various cylindrical apertures 25 represented by the aperture openings 39 on the sides of the podium to telescopically or nestably position the base units 1, 2, and 3 with respect to one another to provide the desired height required for a particular student. When the pin 66 has been removed from a particular aperture 25, and the podium repositioned to the desired height, the pin member 66 is then re-inserted by releasing it and allowing it to enter aligned into the nearest apertures 65, 25 to lock the units at that desired height until it is again desired to re-adjust the height for the next speaker or the like.

Similarly, the handle 55 can be grasped for opening and closing a drawer member 4 in the third base unit 3, as desired. Furthermore, the arm 6 may be raised to position the disk-like hands 37 in a horizontal position or compressed and stored flush against the sides of the podium, as desired.

In FIG. 1, the happy face is shown as being operably disposed on the rear side 32 of the podium 31 facing the speaker. This is done in order to ease the speaker's apprehensions, fears and timidity. It will, of course, be understood that a similar face can be placed on the opposite side 35 to face the audience in order to mellow, relax, or reduce the fears and apprehensions of the audience so as to produce a more receptive, happy, and less fearsome audience.

The sets of facial features of faces can also be made of a stick-on type material such as decals, transfers, or flexible magnetic strips; and different faces can be placed on either or both of the front and rear sides depending upon the likes and dislikes of a particular speaker, audience etc. For example, a set of masculine or feminine features can be incorporated depending upon the needs of the speaker, and various items such as hairstyles, facial features and the like can be used, depending upon the sex or the likes of the user, as desired. It must also be realized that other modifications can be made, for example, covering the wheels 27 with clown-like large feet or robot-like pads similar to the arms and hands previously described.

The podium can also be given a name intended to amuse and relax the audience and speaker as well, and/or it can be actually introduced by the speaker or teacher to further relax everyone and create a less formidable speaking environment. For example, a "female" clown-like podium could be named "Bozina" while a "male" clown-like podium could be named "Bozo". Similarly, the names and decor could be chosen from fantasy, from Saturday morning TV shows, comics, or the like by the speaker himself or herself.

It will also be understood that the audience and the child actually speaking can even be further relaxed and amused and their fears and apprehensions further alleviated by placing various objects, materials, show and tell exhibits and the like on the extended hands; and the robot-like features of the podium can be even further emphasized, if desired.

The podium 31 would normally be constructed from a relatively lightweight material such as wood, plywood, or plastic material which would make the podium easily movable from one location or room to another even by a child. The lightweight construction would also enable the height of the podium to be more easily adjusted. The podium would normally be painted in psychologically relaxing or happy colors to prevent dark, ominous or over-bearing appearances, such as normally presented by most adult podiums on the market today.

It will be understood by those of ordinary skill in the art that various modifications, changes, variations and substitutions can be made in the present invention without departing from the spirit and scope thereof which is limited only by the appended claims.

I claim:

1. A child's podium for teaching pre-school and elementary school age children to speak in front of a group by substantially eliminating the fear, apprehension, tension, and anxiety normally associated with standing and speaking in front of a group, said child's podium comprising:

a podium having a bottom portion, a front, a rear, a pair of sides, and a top surface means for holding a speaker's notes;

manually-selectable height-adjustment means for manually adjusting the height of the podium for a given individual's height;

facial feature means operatively disposed on at least one of the front and rear surfaces of the podium for providing a relaxed atmosphere for at least one of the speaker and the group to whom said speaker is speaking;

arm means operably disposed on the opposite pair of sides of said podium, said arm means being selectively positionable to a first retracted position substantially within the podium and to a fully extended position out of the sides of the podium;

hand means operatively disposed on the distal ends of said arm means, said hand means including a relatively flat surface which is disposed substantially horizontal when said arm means are manually positioned in said extended position, said flat surface of said hand means being adapted for holding objects and simultaneously providing said podium with the appearance of a robot-like being.

2. The child's podium of claim 1 wherein said podium includes at least three box-like units adapted to be telescopically received within one another in a nestable fashion for height adjustment purposes.

3. The child's podium of claim 1 wherein at least one side of each of the box-like units of said podium include a plurality of vertically aligned apertures and each of said units including spring-biased member including an anchor portion operatively secured to the side of said unit and an elongated locking pin adapted to be selectively positioned within any given one of said vertically aligned apertures for selecting distance which one of said box units is telescopically received into another and hence the height of said podium.

4. The child's podium of claim 3 wherein said spring-biased member includes substantially flat end portion anchored to the side of said unit, an intermediate portion including an aperture for grasping same for selectively moving the elongated pin member into and out of said apertures, as desired.

5. The child's podium of claim 1 wherein said facial feature means includes means for forming a happy, user friendly, clown-like face.

6. The child's podium of claim 5 wherein said facial feature means includes a pair of knob-like units disposed at opposite end portions of front surface of the top box-like unit imitating at least one of ears and cheeks, smile means, eyes, and a nose.

7. The child's podium of claim 5 wherein at least one of the front and rear of said podium include said indicia means forming said clown-like face.

8. The child's podium of claim 7 wherein both of said front and rear surfaces of said podium include said facial feature means.

9. The child's podium of claim 1 further including base support means for operatively supporting the bottom portion of said podium and wheel means operatively disposed on the bottom of said base support means for enabling said podium to be easily positioned from one location to another.

10. The child's podium of claim 9 wherein said wheel means includes means for locking said wheels in a fixed position to prevent said podium from being moved from a desired location once positioned thereat.

11. The child's podium of claim 10 wherein at least one of said box-like units include a storage area operably disposed within the hollow interior of said podium.

12. The child's podium of claim 1 wherein said arm means includes a pair of arcuate members each including one end portion operatively disposed within said podium and an opposite end portion adapted to carry a platform means and for supporting said platform means in a substantially horizontal position.

13. The child's podium of claim 12 wherein said platform means includes a relatively flat disk-shaped members adapted for operatively supporting objects thereon.

14. The child's podium of claim 13 wherein said arm means further include an accordion-like covering sleeve means operatively circling said arcuate member from one end to the other giving the arm means on appearance of substance.

15. A child's podium comprising:

at least first and second generally rectangular box-like units, each of said box-like units having a pair of generally parallel side panels spaced a predetermined distance apart, a front panel, and a rear panel spaced a second predetermined distance apart from said front panel and being generally parallel thereto, said side panels being operatively coupled to said front and rear panels and generally perpendicular thereto for forming said hollow, four-sided, box-like units, said first box-like unit being dimensioned greater than said second box-like unit for telescopically receiving at least a portion of said second box-like unit slidably therein;

means operatively disposed on the opposite sides of said first and second box-like units for manually selecting the depth to which said second box-like unit is telescopically vertically received into said first box-like unit and thereby selectively varying the vertical height of said podium depending upon the height of the user standing thereat; and permanently fixed facial feature means operatively carried by at least one of said front and rear panels of said podium for imparting a friendly character-like image to at least one of the audience and the speaker for relieving tension, apprehension and fear.

16. The podium of claim 15 wherein the sides of said podium include arm means including means for retracting said arm means substantially within said podium and extending said arm means out of said podium to impart a robot-like appearance thereto.

17. The podium of claim 16 further including platform-like hand members operatively disposed on the outer distal end of said arm means adapted to be stored flush against the side of said podium when said arm means is in a retracted position and adapted to be positioned in a horizontal manner for holding objects and the like when said arm means is positioned in said extended or disposed position.

18. The podium of claim 15 wherein said podium includes a bottom portion and wheel means operatively disposed on said bottom portion of said podium for manually moving said podium for positioning same from one physical location to another.

19. The podium of claim 18 wherein said wheel means includes wheel locking means for selectively, manually locking the position of said wheels to prevent rolling once said podium has been positioned in a desired location.

20. The podium of claim 15 further including an additional set of permanently fixed facial feature means for operatively carrying first and second happy, user-friendly facial features on both the front and rear panels of said podium for relaxing both the audience and the speaker.

21. A podium for teaching children to be unafraid of speaking before groups comprising:

a plurality of telescopically nested, generally rectangular, box-like means disposed upon one another such that each box-like means has interior dimensions and an upper box-like means has interior dimensions substantially greater than the next lower adjacent box-like means such that said upper box-like means may be slidably received over said next lower adjacent box-like means;

height-adjustment means operatively carried by at least two of said plurality of box-like means for selecting the vertical height of the podium for each individual speaker;

decorative facial feature means operatively carried on at least one of the front and rear surfaces on at least one of said box-like means for relaxing at least one of the speaker and the audience;

arm means supporting a substantially flat platform means for positioning objects in plain view of the audience, said arm means being manually adjustable between a fully extracted use position wherein said platform means is supported in a substantially horizontal position and a fully retracted storage position wherein said arm means is housed within the hollow interior of one of said box-like means and said platform means is disposed flush against the sides of said box-like means in and out-of-the-way storage position.

22. A children's podium for introducing public speaking to preschool and grade school age children, said podium including a platform adapted to support papers at a level for convenient viewing by a young speaker standing before said podium, said podium having a front surface, a rear surface, a pair of sides, a sloped top surface, and at least one set of facial features preferably disposed on at least one of said front and rear surfaces for presenting a happy user-friendly comical character's face for relaxing and minimizing any anxiety and fear normally associated with public speaking for at least one of the speakers and the audience, said podium having selectively-variable height-adjustable sections which facilitate vertical height adjustment of said sloped top surface to suit an individual user's height needs.

23. The podium of claim 22 wherein said podium includes a pair of robot-like arms operably dispose on the opposite sides of said podium.

24. The podium of claim 23 wherein said robot-like arms includes platform means operatively disposed at the distal ends thereof for resembling hands.

25. The podium of claim 24 wherein said platform means includes a flat surface and wherein said robot-like arms include an arcuate arm member positionable between a first fully retracted storage position for positioning said platform means flush against the sides of said podium and a fully extended use position for positioning a surface of said platform means in a relatively horizontal position for receiving and holding objects on the surface thereof.

26. The podium of claim 22 wherein said set of facial features may include knob means resembling at least one of eyes, nose, cheeks, and ears.

27. The podium of claim 22 further including a top surface which is generally tilted downwardly towards said standing speaker, said tilted surface being adapted to position materials to be viewed by said speaker thereon and further including prop means at the lower end thereof for preventing said materials from sliding off of said tilted surface.

28. The podium of claim 22 wherein said podium includes a front and rear surface and wherein at least one set of facial features includes a first set operatively disposed on the front of said podium for relaxing the audience and a second set of facial features operatively disposed on the rear surface of said podium for relaxing the speaker.

29. The podium of claim 22 wherein said height adjustment means includes pin and aperture means operatively disposed on the sides of said podium for selectively varying the vertical height of said podium without varying the slope of the top surface thereof in order to accommodate children of different heights standing at said podium.

30. The podium of claim 29 further including at least first and second nested box-like structures, each of said box-like structures including a pair of spaced apart opposite side panels generally parallel to one another, a front surface panel, a rear surface panel being generally perpendicular to said front and rear surfaces and interconnecting same for forming said generally hollow four sided box-like structure, said first box-like structure being operatively dimensioned to be slidably vertically received within the hollow interior of said second box-like structure and selectively positioned to different vertical depths therein for manually adjusting the height of the top sloped surface of said podium to accommodate children of different heights standing before said podium for speaking purposes.

* * * * *